United States Patent [19]

Gaskill, Jr.

[11] 4,444,315

[45] Apr. 24, 1984

[54] Z-FOLD CHART PAPER PACKAGE

[75] Inventor: David M. Gaskill, Jr., Providence, R.I.

[73] Assignee: Atlan-Tol Industries, Inc., West Warwick, R.I.

[21] Appl. No.: 475,347

[22] Filed: Mar. 14, 1983

[51] Int. Cl.[3] ..... B41L 1/32; B65D 85/62; B65D 5/02

[52] U.S. Cl. ..... 206/449; 206/494; 270/39; 271/145

[58] Field of Search ..... 206/449, 494; 282/19 R; 271/145; 270/39

[56] References Cited

U.S. PATENT DOCUMENTS

| | | | |
|---|---|---|---|
| Re. 23,029 | 8/1948 | Delson | 206/449 |
| 2,363,661 | 11/1944 | Feitl | 282/19 R |
| 3,631,972 | 1/1972 | Gendron et al. | 206/449 |

FOREIGN PATENT DOCUMENTS

| | | | |
|---|---|---|---|
| 602914 | 6/1948 | United Kingdom | 206/449 |

*Primary Examiner*—William T. Dixson, Jr.
*Attorney, Agent, or Firm*—Salter & Michaelson

[57] ABSTRACT

A chart paper package for chart recording devices and the like includes a stack of paper comprising an elongated paper strip folded in a zigzag configuration, and an elongated flexible wrapper, which is of normally closed loop configuration and snugly received on the stack, but which is separable to an open configuration to provide access to the paper. The package can be installed in a recorder with the wrapper on the stack and thereafter the wrapper can be separated to provide access to the paper, whereby the risk of having the paper become inadvertently unfolded during the installation thereof in the recorder is avoided.

3 Claims, 4 Drawing Figures

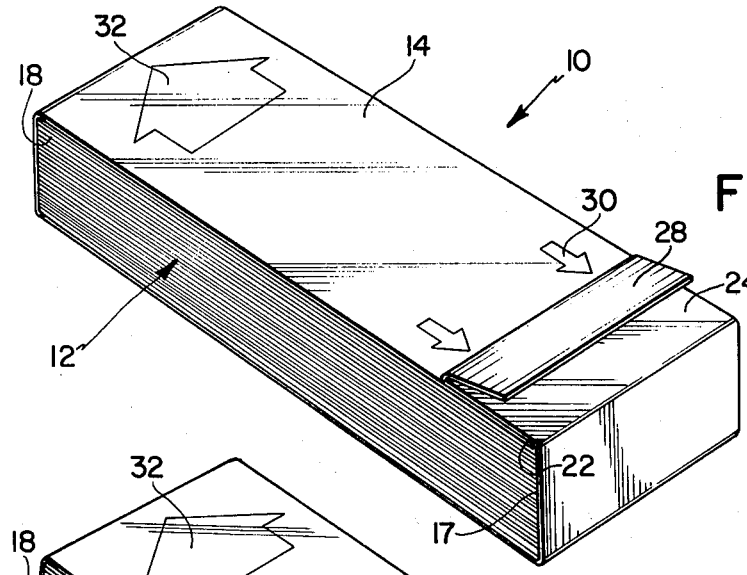
FIG. 1
FIG. 2
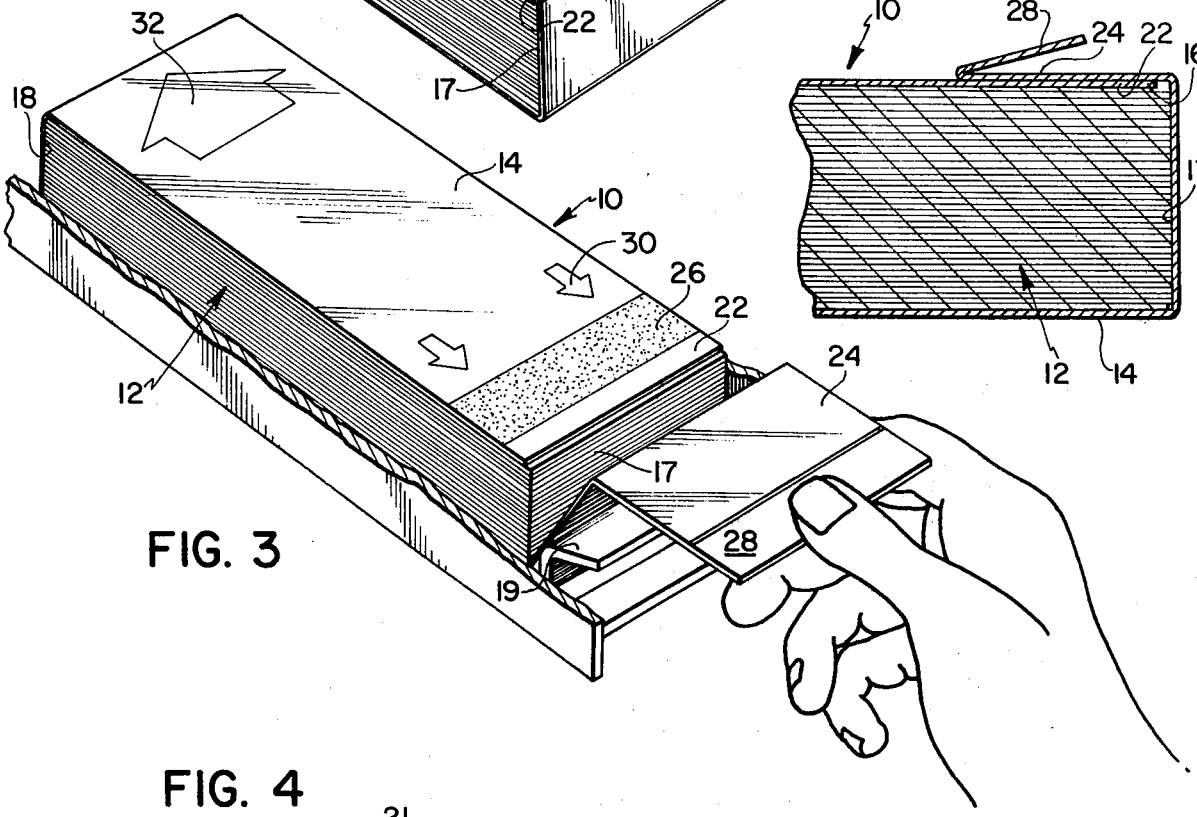
FIG. 3
FIG. 4
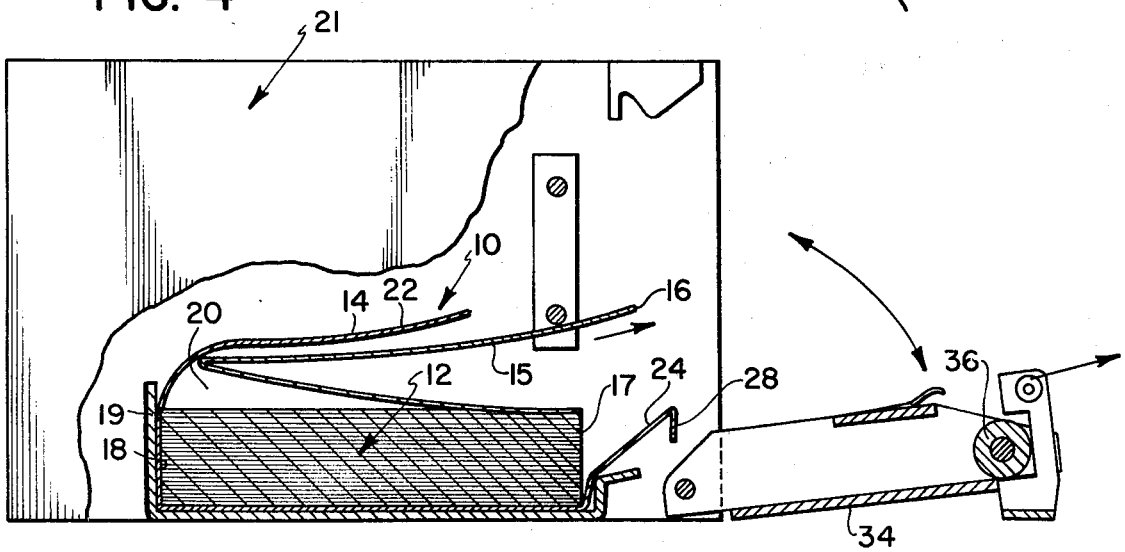

Z-FOLD CHART PAPER PACKAGE

BACKGROUND AND SUMMARY OF THE INVENTION

The instant invention relates to chart paper of the 'pe used in chart recorders and the like and more parcularly to a package for facilitating the loading and andling of chart paper of the type commonly referred › as Z-fold paper, i.e., paper which is folded in a zigzag onfiguration.

Many of the chart recording devices currently in use tilize Z-fold chart paper comprising an elongated strip f paper which has been folded in zigzag configuration › form a stack of paper wherein sequential fold lines of ıe paper define opposite first and second ends of the ack. In use, a stack of paper is received in a compartıent in a recorder and one end of the paper is received ı an advancing mechanism in the recorder, whereby ıe paper is gradually unfolded as it is dispensed from ıe stack and sequentially advanced to a stylus as eeded. Z-fold paper of this type has been used in reorders to provide effective trouble free supplies of ontinuous paper therefor, and hence the use of Z-fold aper for chart recorders has become extensive.

While Z-fold chart paper of the above described type an be effectively used in chart recorders, it has been ›und that frequently stacks of Z-fold paper become ıadvertently unfolded during the installation thereof in ıe proper compartments in recorders. In this regard, ıe inadvertent unfolding of a stack of Z-fold paper can epresent a substantial inconvenience to an operator of ıe recorder who is attempting to effect the loading ıereof because the paper must be manually refolded to ıe proper configuration before the attempted loading f the paper in the recorder can again be effected. Acordingly, heretofore the possiblity of the inadvertent nfolding of a stack of Z-fold paper during the atempted loading thereof in a recorder has represented a gnificant drawback to the use of such paper.

The instant invention provides a novel solution to the roblems heretofore encountered in the loading of Z-›ld paper into recorders by providing a Z-fold paper ackage which can be installed in a recorder without ny risk of the paper being inadvertently unfolded. pecifically, the loading package of the instant invenon comprises an elongated flexible wrapper of norıally closed loop configuration which is snugly receivble on a stack of paper so that it extends along the pper and lower faces and ends thereof but which is eparable to an open configuration to provide access to ıe paper subsequent to the loading of the package in a ecorder. In the preferred embodiment of the package, ıe wrapper has first and second end portions which are etachably interconnected to define the separable losed wrapper loop. Further, the first and second end ortions preferably terminate adjacent one end of the ack of folded paper and on the upper face thereof, and ıe first end portion terminates in a free tab portion so ıat the first end portions is separable from the second nd portion upon movement of the tab portion towards ıe adjacent end of the stack. In addition, the Z-fold aper is preferably arranged so that the leading edge ıereof is disposed adjacent the point where the first nd second end portions of the wrapper are detachably ıterconnected. Accordingly, the loading package is eceivable in the chart paper compartment of a recorder › that the interconnected end portions of the wrapper are adjacent the access opening of the compartment and thereafter the interconnected end portions can be separated by manipulation of the tab portion. The leading edge of the chart paper can then be fed into the advancing mechanism of the recorder and the paper may be dispensed from the stack as needed with the wrapper remaining in the paper compartment still surrounding the Z-folded paper. In the event that circumstances make it necessary to remove the unused portion of the paper stack from the paper compartment, the wrapper facilitates such removal without allowing the Z-folded paper to become inadvertently unfolded.

Devices representing the closest prior art to the instant invention of which the applicant is aware are disclosed in the U.S. patents to Weilby, U.S. Pat. No. 2,956,674, Lindenmuth et al., U.S. Pat. No. 3,443,093, Gendron et al., U.S. Pat. No. 3,631,972, and Smolderen, U.S. Pat. No. 4,093,069. While these patents disclose various devices for the packaging of sheet materials they do not disclose or suggest a package comprising a flexible wrapper of the type hereinabove set forth which can be utilized to facilitate the loading of Z-fold paper in a chart recorder. Hence, the above references are believed to be of nothing more than general interest.

It is, therefore, a primary object of the instant invention to provide a package which can be utilized to facilitate the loading of Z-fold chart paper in the chart paper compartment of a recorder.

Another object of the instant invention is to provide means to minimize the risk of having Z-fold paper become inadvertently unfolded during the loading thereof in a chart recorder.

Another object of the instant invention is to provde a flexible wrapper for Z-folded chart paper which can be inserted with the paper into the chart paper compartment of a recorder.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention:

FIG. 1 is a perspective view of the chart paper package of the instant invention;

FIG. 2 is an enlarged fragmentary sectional view of one end of the package illustrating the interconnection of the end portions of the package wrapper;

FIG. 3 is a perspective view of the package received in the chart paper compartment of a recorder illustrating the manipulation of the package to provide access to the chart paper thereof; and FIG. 4 is a fragmentary sectional view of the package received in the chart paper compartment of a recorder.

DESCRIPTION OF THE INVENTION

Referring now to the drawing, the chart paper loading package of the instant invention is illustrated and generally indicated at 10 in FIGS. 1–4. The package 10 comprises a stack of folded paper 12 and a flexible wrapper 14 which is snugly received on the stack 12, the wrapper 14 being of normally closed loop configuration as illustrated in FIGS. 1 and 2 but being separable to an open configuration as illustrated in FIGS. 3 and 4 to provide access to the stack 12.

The stack 12 comprises an elongated strip of paper 15 of the type commonly referred to as Z-fold paper having a leading edge 16 and a trailing edge (not shown), and folded in a zigzag configuration wherein sequential fold lines in the paper define opposite first and second ends 17 and 18, respectively, of the stack 12. The leading edge 16 lies adjacent an upper or first face of the stack 12, preferably adjacent the first end 17, and the trailing edge of the strip 15 lies adjacent the second or opposite face of the stack 12. Accordingly the paper strip 15 can be dispensed from the stack 12 in an orderly and sequential manner by advancing the leading edge 16 as illustrated in FIG. 4. The stack 12 is preferably dimensioned to be received in a tray 19 in a paper compartment 20 of a recorder 21 as illustrated in FIG. 4.

The wrapper 14 comprises an elongated flexible member, which is preferably constructed of paper, having first and second end portions 22 and 24, respectively. The wrapper 14 is dimensioned so that it is receivable on the stack 12 with the wrapper extending completely around the stack, i.e., around the first and second faces thereof and around the first and second ends 17 and 18 thereof, respectively. The first and second end portions 22 and 24 are normally detachably interconnected with an adhesive 26 to maintain the wrapper 14 snugly around the stack 12. In this regard, the second end portion 24 preferably overlies the first end portion 22 so that the adhesive 26 is secured to the second end portion 24 in an area which is spaced from the terminal end thereof to define a free terminal flap 28 on the second end portion 24. Further, the first and second end portions 22 and 24 are preferably interconnected on the upper or first face of the stack 12 at a point adjacent the first end 17. Accordingly, the first and second end portions 22 and 24 may be separated by an outward pull of the flap 28 in the general direction of the first end 17 to provide access to the stack 12, in particular to the leading edge 16. A pair of arrows 30 are provided on the wrapper 14 to indicate the direction of movement of the flap 28 necessary for this operation.

In use and operation the package 10 is receivable in the tray 19 in the chart paper compartment 20 of the recorder 21 as illustrated in FIG. 4. After the package 10 has been positioned in the tray 19 as directed by an arrow 32 on the wrapper 14 so that the second end 18 is adjacent the inner end of the tray 19 and so that the first end 17 is proximal the access opening of the chart paper compartment 20, the second end portion 24 is separated from the first end portion 22 by moving the flap 28 generally outwardly as directed by the arrows 30 or in the general direction of the first end 17. Thereafter the portion of the strip 15 adjacent the leading edge 16 thereof can be withdrawn from the tray 19 and inserted into an advancing mechanism of the recorder 21. In this connection, as herein embodied, the recorder 21 includes an access door 34 on which an advancing assembly 36 is mounted and accordingly when the package 10 is used in combination with a recorder of the type herein illustrated, the leading edge 16 is fed to the advancing assembly 36 on the door 34. Obviously, however, the package 10 is usable in other types of recorders having other types of advancing assemblies.

It is seen, therefore, that the instant invention provides a novel and effective chart paper package which eliminates the disadvantages experienced when conventional unwrapped or unpackaged Z-fold paper is utilized in chart recorders. Specifically, the package 10 can be inserted in the chart paper compartment of a recorder 21 with minimal risk of having the stack 12 become inadvertently unfolded. After the package 10 has been inserted into the recorder 21, the ends 22 and 24 can be separated to provide access to the paper 15. Since the wrapper 14 is flexible, it can remain in the recorder 21 until all of the paper 15 has been dispensed without interferring with the operation of the recorder 21. In the event, however, that it becomes necessary to remove an unused portion of the stack 12 from the recorder 21, the wrapper 14 can be wrapped around the unused portion to facilitate this operation so that the unfolding of the paper 15 is avoided. Accordingly, it is seen that the package 10 provides a significant advancement in the art which, for the reasons hereinabove set forth, has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A chart paper package for a recorder and the like of the type having an elongated chart paper compartment for receiving and containing chart paper in said recorder and the like, and for dispensing said paper therefrom for use in said recorder and the like, said compartment having an access opening at one end thereof for the loading thereof, said package comprising:

a. a stack of paper defined by an elonated paper strip having leading and trailing edges and folded in a zigzag configuration, sequential fold lines in said strip defining opposite first and second ends of said stack, the portions of said stack adjacent said leading and trailing edges lying in opposite first and second faces, respectively, of said stack, and b. a flexible wrapper of closed loop configuration snugly received on said stack so that it extends along said faces thereof, said wrapper being separable to an open configuration to provide access to said stack, said wrapper having first and second end portions, said second end portion overlying said first end portion and terminating in a free tab portion, said first and second end portions being detachably interconnected adjacent said second stack end, said leading edge being disposed adjacent said second stack end, said package being receivable in the chart compartment of said recorder with said second stack end adjacent the access opening to said compartment, c. whereby said stack is insertable in said compartment with said wrapper received on said stack to prevent the unfolding thereof, and thereafter said wrapper is separable to said open configuration to provide access to said stack for the dispensing thereof.

2. The wrapper of claim 1, further characterized as a paper wrapper.

3. A method of loading chart paper in a chart recorder, wherein the recorder is of the type having an elongated chart paper compartment for receiving and containing chart paper in said recorder and for dispensing said paper for use in said recorder, said compartment having an access opening at one end thereof for the loading thereof, said method comprising the steps of:

a. inserting a chart paper package in said compartment through said access opening, said package comprising a stack of paper defined by an elongated paper strip having leading and trailing edges and folded in a zig-zag configuration, sequential fold lines in said strip defining opposite first and second ends of said stack, the portions of said stack adjacent said leading and trailing edges lying in opposite first and second faces of said stack, respectively, and a flexible wrapper of closed loop configuration snugly received on said stack so that it extends along said faces thereof, said wrapper being separable to an open configuration to provide access to said stack; and b. thereafter separating said wrapper to an open configuration to provide access to said stack.

* * * * *